US006910927B2

(12) United States Patent
Kanno

(10) Patent No.: US 6,910,927 B2
(45) Date of Patent: Jun. 28, 2005

(54) SMALL WATERCRAFT AND OUTBOARD MOTOR

(75) Inventor: Isao Kanno, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 78 days.

(21) Appl. No.: 10/281,390

(22) Filed: Oct. 24, 2002

(65) Prior Publication Data

US 2003/0109184 A1 Jun. 12, 2003

(30) Foreign Application Priority Data

Oct. 24, 2001 (JP) ..... 2001-326813

(51) Int. Cl.[7] ..... B63H 21/22
(52) U.S. Cl. ..... 440/1; 440/61 G
(58) Field of Search ..... 114/144 R; 440/1, 440/2, 61 T, 61 G

(56) References Cited

U.S. PATENT DOCUMENTS

| | | | | |
|---|---|---|---|---|
| 4,649,708 | A | | 3/1987 | Fisher |
| 4,708,669 | A | | 11/1987 | Kanno et al. |
| 4,822,307 | A | | 4/1989 | Kanno |
| 4,850,906 | A | | 7/1989 | Kanno |
| 5,136,279 | A | | 8/1992 | Kanno |
| 5,175,481 | A | | 12/1992 | Kanno |
| 5,230,643 | A | | 7/1993 | Kanno |
| 5,295,877 | A | | 3/1994 | Kanno |
| 5,352,138 | A | | 10/1994 | Kanno |
| 5,366,394 | A | | 11/1994 | Kanno |
| 5,481,261 | A | | 1/1996 | Kanno |
| 5,582,149 | A | | 12/1996 | Kanno |
| 5,606,952 | A | | 3/1997 | Kanno et al. |
| 5,615,645 | A | | 4/1997 | Kanno |
| 5,632,217 | A | * | 5/1997 | Ford et al. ..... 114/150 |
| 5,685,802 | A | | 11/1997 | Kanno |
| 5,687,694 | A | | 11/1997 | Kanno |
| 6,141,608 | A | | 10/2000 | Rother |
| 6,213,820 | B1 | | 4/2001 | Kanno |
| 6,286,492 | B1 | | 9/2001 | Kanno |
| 6,308,651 | B2 | * | 10/2001 | McKenney et al. ..... 114/144 R |
| 6,325,046 | B1 | | 12/2001 | Kanno |
| 6,357,423 | B1 | | 3/2002 | Kanno |
| 6,375,525 | B1 | | 4/2002 | Kanno |
| 6,377,879 | B2 | | 4/2002 | Kanno |
| 6,415,766 | B1 | | 7/2002 | Kanno et al. |
| 6,425,362 | B1 | | 7/2002 | Kanno |
| 6,431,930 | B1 | | 8/2002 | Holt |
| 6,453,897 | B1 | | 9/2002 | Kanno |

OTHER PUBLICATIONS

NMEA 2000; Standard for Serial Data Networking of Marine Electronic Devices; Main Document; Version 1.000, Sep. 12, 2001; @NMEA 1999, 2000, 2001.

(Continued)

*Primary Examiner*—Stephen Avila
(74) *Attorney, Agent, or Firm*—Knobbe, Martens, Olson & Bear, LLP

(57) ABSTRACT

A small watercraft and outboard motor are configured so that operator-activated command signals are communicated from a control unit in the hull of the watercraft via a local area network to engine component actuators in the outboard motor. The local area network enables a simplified connection to be used between the watercraft hull and the outboard motor to provide communication of the command signals as well as to provide communication of navigational and engine parameter information. The local area network enables the user to operate the watercraft with increased reliability. Because of the small number (e.g., one) of control connections required between the hull and the outboard motor, the process for installing the outboard motor onto the watercraft hull is greatly simplified, which reduces the time and the cost initial installation and the cost of repair.

20 Claims, 3 Drawing Sheets

OTHER PUBLICATIONS

NMEA 2000; Standard for Serial Data Networking of Marine Electronic Devices; Appendix A; Version 1.000; Sep. 12, 2001; @NMEA 1999, 2000, 2001.

NMEA 2000; Standard for Serial Data Networking of Marine Electronic Devices; Appendix B; @NMEA 1999, 2000, 2001.

NMEA 2000; Standard for Serial Data Networking of Marine Electronic Devices; Appendix C; Version 1.000; Sep. 12, 2001; @NMEA 1999, 2000, 2001.

NMEA 2000; Standard for Serial Data Networking of Marine Electronic Devices; Appendix D; Version 1.000; Sep. 12, 2001; @NMEA 1999, 2000, 2001.

NMEA 2000; Standard for Serial Data Networking of Marine Electronic Devices; Appendix E; ISO 11783–5 Network Management.

NMEA 2000; Standard for Serial Data Networking of Marine Electronic Devices; Appendix F; ISO 11783–3 DataLink Layer.

NMEA 2000; Standard for Serial Data Networking of Marine Electronic Devices; Appendix G; ISO 11898 Controller Area Network.

International Standard IS) 11783–5, First Edition May 1, 2001, Part 5; Network management.

* cited by examiner

SMALL WATERCRAFT AND OUTBOARD MOTOR

PRIORITY INFORMATION

This application is based on and claims priority under 35 U.S.C. § 119 to Japanese Patent Application No. 2001-326813, filed on Oct. 24, 2001, the entire contents of which are hereby expressly incorporated by reference herein.

BACKGROUND OF THE INVENTION

1. Field of the Invention

The invention relates to a local area network (LAN) system for communicating control signals and other information in a small watercraft having an outboard motor.

2. Description of the Related Art

Watercraft (e.g., personal watercraft or boats) typically incorporate internal combustion engines along with propulsion units to provide power and propel the watercraft in a variety of popular applications. The internal combustion engines and propulsion units are outboard motors on many watercraft. In a conventional watercraft, cables, wires, and hoses are used to manage and operate the watercraft and the outboard motor. The number of cables, wires and hoses needed to interconnect the hull and the outboard motor often introduce complications and delays when mounting the outboard motor to the hull.

For example, cables and wires are conventionally used to control a throttle that regulates the opening of an engine throttle valve of the outboard motor, to control a shift device that switches a transmission to provide forward, reverse and neutral operational modes of a propulsion unit of the outboard motor, and to control a steering mechanism that translates a driver's steering requests into directional movements of the propulsion unit. Hoses supply fuel from a fuel tank to the outboard motor and supply oil from an oil tank to the outboard motor. A wiring harness enables communication between the outboard motor and the hull. For example, navigational information, engine parameters and watercraft parameters are communicated via the wiring harness to a display to be viewed by the operator. A battery cable supplies electrical energy from a battery disposed in the hull to the outboard motor.

An arrangement utilizing electrically controlled throttle and transmission activation was proposed in the Japanese Patent JP 3065369. A remote control unit is disposed proximate to the operator's seat in the hull to enable the operator to perform the shifting and throttling operations via electrical signals communicated from the remote control unit. The electrical signals are communicated to electric motors mounted in the hull that operate actuators and other devices. The actuators and other devices in the hull move wires in response to the operation of various levers of the electronic remote control unit by the operator to cause the shifting and throttling operations. Thus, the outboard motor is controlled according to the movement of the control levers without requiring direct mechanical interconnections from the control levers to the outboard motors. Yet, wires are used to transmit forces mechanically from the actuators and other devices mounted in the hull to the outboard motor to control the engine throttle, transmission shifting, and steering. The actuator wires must be connected between the actuators and the outboard motor when the outboard motor is installed on the hull of the watercraft.

Recently, local area network (LAN) systems and developing information technology have been used in watercraft to interconnect the hull and the outboard motor. Known LAN systems communicate with the outboard motor and the watercraft to receive parameters representing the operation of the outboard motor and the watercraft. Information responsive to the parameters are displayed to the watercraft operator. Although such LAN systems reduce the number of wire harnesses in the watercraft, conventional LAN techniques are used only to communicate watercraft and outboard motor parameters to the operator's display, and the LAN systems are not used to communicate control information from the remote throttle and shifting control unit and from the steering device to actuate the motors that operate the throttle, shifting, and steering mechanisms. Therefore, the number of wires used to control a drive-by-wire system in known watercraft has not been significantly reduced.

SUMMARY OF THE INVENTION

In accordance with aspects of embodiments of the present invention, a local area network (LAN) system interconnects a watercraft and an outboard motor with minimal connections and wiring to improve the reliability of the interconnections and to simplify the installation time of the outboard motor. The time required to mount the outboard motor to the hull is reduced because of the significant reduction in the number of wires and cables that need to be installed and connected. The LAN system communicates control signals and other information between the hull and the outboard motor. The LAN system enables operation of throttle and transmission actuation and informs the watercraft operator of various watercraft and outboard motor engine parameters.

In particular, a watercraft incorporating the embodiments described herein comprises a hull with an outboard motor attached to the rear part of the hull. The watercraft includes a plurality of operator-input systems disposed proximate to the operator's seat in the hull. The operator-input systems enable operations of the watercraft such as, for example, throttling, shifting, and steering. Response actuators are disposed in the outboard motor. The response actuators control engine parameters in accordance with the operator's requests as applied to the operator-input systems. The operator requests are communicated from the operator-input systems to the response actuators via a LAN communication system. Using the LAN communication system increases the performance and reliability of the watercraft and simplifies the mounting of the outboard motor to the hull of the watercraft.

One aspect of an embodiment in accordance with the present invention is a watercraft that includes an outboard motor mounted on a hull and that includes an operator-controlled navigational unit positioned in the hull. The navigational unit comprises at least one engine operation control unit that receives throttle and shift commands and that generates throttle and shift command signals. The navigational unit further comprises a control unit that receives steering commands and that generates steering command signals. A trim selection control unit receives trim selection commands and generates trim selection command signals. The outboard motor includes actuators that are responsive to control signals to operate a throttle body, a transmission, a steering system, and a trim system in the outboard motor. A control system in the outboard motor is connected via a communication system to the navigational unit. The control system receives the command signals from the control units in the navigational unit via the communication system and generates the control signals to the actuators in the outboard motor.

Another aspect of an embodiment in accordance with the present invention is a watercraft that includes an outboard motor. The outboard motor includes an engine that produces a propulsion force through a transmission mechanism. The watercraft comprises an operator-controlled navigational system. The navigational system includes at least one engine operation control unit that receives throttle and shift command inputs, a steering control unit that receives steering command inputs, and a trim control unit that receives trim selection command inputs. The control units generate respective control signals responsive to operator inputs applied to the control units. A display system is located proximate to the navigational system. Actuators in the outboard motor operate a throttle body, a transmission, a steering system, and a trim system in response to respective actuator signals. Sensors detect operating conditions of the watercraft. A control system in the outboard motor communicates with the sensors and with the actuators. The control system is connected via a communication system to the navigational system to receive the control signals from the control units. The control system responsive to the control signals to generate the actuator signals to the actuators. The control system further generates signals to the display system to cause the display system to display information responsive to the detected operating conditions of the watercraft.

Another aspect of an embodiment in accordance with the present invention is an outboard motor mounted on a watercraft. The watercraft includes a navigation system that receives control inputs from an operator. The outboard motor includes an engine that produces a propulsion force through a transmission mechanism. The outboard motor comprises actuators that operate a throttle body, a transmission, a steering system, and a trim system. A control system communicates with the navigation system of the watercraft via a communication system. The control system controls the actuators in response to commands received from the navigation system.

Another aspect of an embodiment in accordance with the present invention is an outboard motor mounted on a watercraft. The outboard motor includes an engine that produces a propulsion force through a transmission mechanism. The outboard motor comprises actuators in the outboard motor that operate a throttle body, a transmission, a steering system, and a trim system. A control system communicates with a navigation system located in the watercraft. The control system operates actuators in the outboard motor in response to commands received via a communication system from the navigation system. The control system further generates information signals responsive to operating conditions of the outboard motor and the watercraft, and the control system communicates the information signals to a display associated with the navigation system.

BRIEF DESCRIPTION OF THE DRAWINGS

Embodiments in accordance with aspects of the present invention will be described below in connection with the accompanying drawing figures in which.

DETAILED DESCRIPTION OF THE PREFERRED EMBODIMENT

Figure 1:
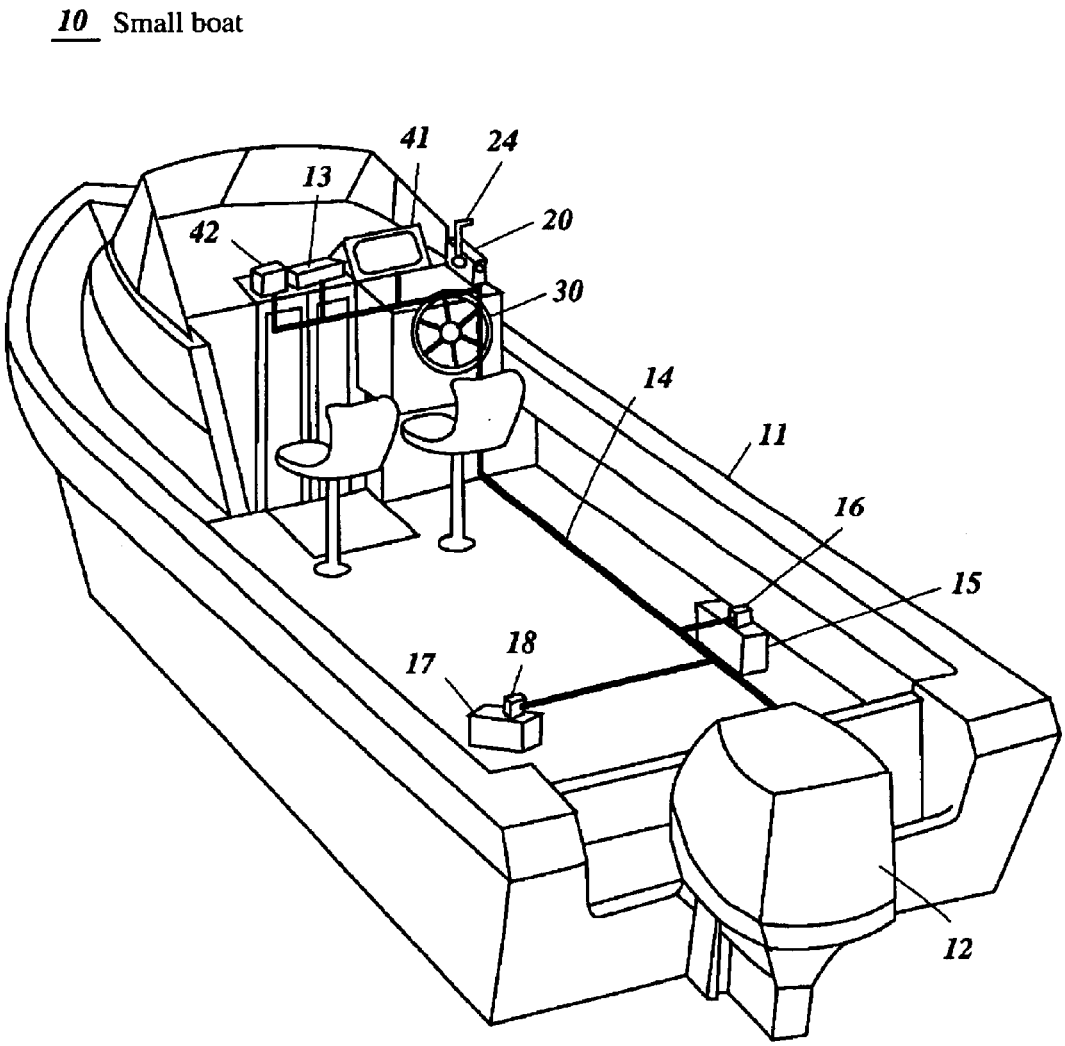
FIG. 1 is a pictorial illustration of an exemplary watercraft that includes an outboard motor mounted on a hull and that further includes a local area network (LAN) installed between the hull and the outboard motor to enable communication of operator requests from controls in the hull to an electronic control unit that provides actuator signals to a plurality of actuators in the outboard motor.

As illustrated in FIG. 1, a watercraft 10 comprises a hull 11 for carrying passengers. An outboard motor 12 is attached to the rear part of the hull 11. In preferred embodiments, communication between the hull 11 and the outboard motor 12 is provided by a controllable area network compatible (CAN-compatible) LAN cable 14 constructed in accordance with the controllable area network specification for vehicles. The cable 14 can also be constructed and operated in accordance with work specifications.

The hull 11 comprises an oil tank 15 that stores and supplies oil to the outboard motor 12. An oil sensor 16 detects the amount of oil in the oil tank 15. A battery 17 supplies electrical energy to components in the hull 11 and to the outboard motor 12. A battery sensor 18 detects the voltage of the battery 17. A control unit 20 is located proximate an operator's seat and is thus located remotely from the outboard motor 12. The control unit 20 includes a control lever 24 that is operable by an operator to enable the operator to perform throttling and shifting operations.

Figure 2:
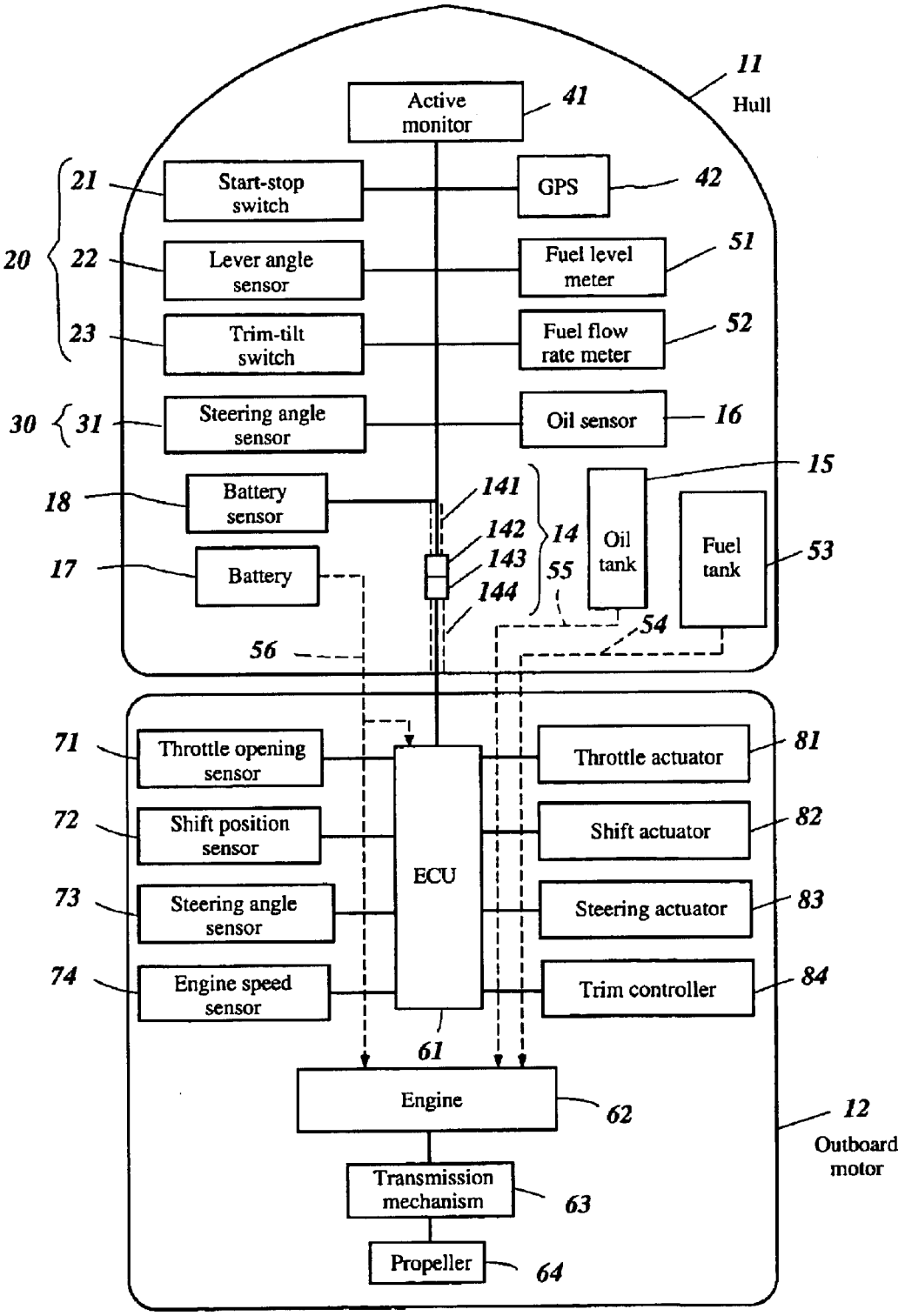
FIG. 2 illustrates a block diagram of the watercraft and outboard motor of FIG. 1, which shows a plurality of engine feedback systems, engine controls and engine components connected electronically through a single local area network.

As illustrated in FIG. 2, the control unit 20 includes a start-stop switch 21, a lever position sensor 22 that senses the position of the control lever 24, and a trim-tilt switch 23. The hull 11 also includes a steering wheel 30 positioned proximate to the operator's seat. The steering wheel 30 includes a steering wheel angle sensor 31. The control unit 20 and the steering wheel 30 enable the operator to control the direction and velocity of the watercraft 10 and are referred to as "navigation-related" devices.

An active monitor 41, a global positioning system (GPS) 42, a wireless transmitter 13, a fuel level meter 51, and a fuel flow rate meter 52 are also positioned proximate to the operator's seat so that the devices can be readily observed by the operator. The active monitor 41 advantageously comprises a cathode-ray tube (CRT) or a liquid crystal display (LCD). As discussed below, the active monitor 41 provides the operator and other persons in the watercraft with information regarding the operation of the watercraft. The GPS 42 receives signals transmitted from a plurality of satellites and processes the signals to determine the position of the watercraft 10.

As further illustrated in FIG. 2, a fuel hose 54 connects the outboard motor 12 to a fuel tank 53 positioned on the bottom of the hull 11. Similarly, an oil hose 54 connects the outboard motor 12 to the oil tank 15. A power cable 56 provides electrical energy from the battery 17 to electrical components in the hull 11 and to the outboard motor 12.

The outboard motor 12 comprises an engine 62 that generates rotational torque by combustion of the fuel from the fuel tank 53 in combination with atmospheric air introduced into combustion chambers at a predetermined air/fuel ratio. The engine 62 transfers the rotational torque to a transmission mechanism 63, which selectively transmits the rotational torque to a thrust generator (e.g., a propeller) 64 in accordance with the enabled shifting operation (e.g., forward, reverse or neutral). The propeller 64 interacts with the surrounding water and converts the rotational torque into a propulsion force to move the watercraft 10 on the water surface.

The outboard motor 12 further comprises an engine control unit (ECU) 61. As discussed below, the ECU 61 controls the operating parameters of outboard motor 12. Although not shown in FIG. 2, the ECU 61 advantageously comprises a central processing unit (CPU), memory devices (ROM, RAM, etc.), auxiliary memory devices (nonvolatile RAM, hard disk, CD-ROM, magneto-optic disk, etc.), and a clock.

The ECU 61 communicates with a plurality of feedback sensors, such as, for example, a throttle opening sensor 71, a shift position sensor 72, a steering angle sensor 73, and an engine speed sensor 74. The sensors inform the ECU 61 of the operating parameters of the engine 62. For example, the engine speed sensor 74 detects the speed of the engine 62 and transmits the detected engine speed information to the ECU 61.

The ECU 61 controls the operating characteristics of the outboard motor 12 via a plurality of actuators such as, for example, a throttle actuator 81, a shift actuator 82, a steering actuator 83, and a trim controller 84. As described herein, the transmission mechanism 63 includes performs a plurality of functions related to the control and the conversion of the rotational torque produced by the engine 62. In particular, the transmission mechanism 63 includes a gear mechanism (not shown), a clutch mechanism (not shown), a throttle valve (not shown), a shifter (not shown) and a turning mechanism.

The throttle actuator 81 opens and closes the throttle valve of the engine 62 according to the lever angle signal from the lever position sensor 22. The throttle valve regulates the amount of an air/fuel mixture supplied to the combustion chambers of the engine in accordance with the degree to which it is opened by the throttle actuator 81. The speed of the engine 62 is responsive to the amount of the air/fuel mixture. Thus, the speed of the engine 62 varies in response to the angle of the control lever 24. The throttle opening sensor 71 detects the opening state (e.g., the percentage or angle of opening) of the throttle valve of the engine 62 and outputs throttle opening information to the ECU 61.

The shifter and the clutch mechanism operate in response to the shift actuator 82 to change the operational mode between the forward, neutral and reverse modes.

The turning mechanism operates in response to the steering actuator 83 to change the direction of the thrust generated by the propeller 64.

The start/stop switch 21 operates as an on-off switch that communicates an engine start signal and an engine stop signal to the ECU 61 in response to manual activation by the watercraft operator. The engine 62 may be started from a non-running still state and may be stopped from a running state based on start and stop signals communicated to the ECU 61 from the start-stop switch 21. The ECU 61 triggers a starter (not shown) to start the engine 62 when a start signal is received. When an engine stop signal is received by the ECU 61, the ECU 61 stops the ignition to the engine 62, stops the fuel delivery to the engine 62, or stops both the ignition and the fuel delivery.

The shift position sensor 72 detects the various states (position) of the transmission mechanism 63, whether it is in the neutral, forward, or reverse position, and outputs the detected shift position information to the ECU 61.

The lever position sensor 22 detects the position angle of the control lever 24 of the remote throttle 20. The lever position sensor communicates an output signal to the ECU 61 to control the throttle actuator 81 and the shift actuator 82. The shifter (not shown) in the transmission mechanism 63 changes the state of rotation of the propeller 64 in response to the power generated by the engine 62. The rotational states of the propeller include a neutral state (non-rotation of the propeller 64), a forward state (rotation of the propeller 64 in a direction that propels the watercraft 10 in the forward direction), and a reverse state (rotation of the propeller 64 in a direction to propel the watercraft 10 in the reverse direction).

For example, when the control lever 24 is moved toward the bow or stern of the watercraft 10, a signal is communicated via the LAN to the ECU 61. When the control lever 24 is moved from a neutral position towards the bow by more than a predetermined angle, the ECU 61 signals the shift actuator 82 to shift the transmission mechanism 63 to the forward state to drive the propeller in the direction that propels the watercraft 10 forward. Likewise, when the control lever 24 is moved from a neutral position towards the stern by more than a predetermined angle, the ECU 61 signals the shift actuator 82 to shift the transmission mechanism 63 to the reverse state to drive the propeller in the direction that propels the watercraft 10 backward.

In addition to controlling the direction of rotation of the propeller 64, when the control lever 24 is tilted toward the bow or toward the stern by more than a predetermined angle, the ECU 61 gradually opens the throttle valve of the engine 62 to allow more air/fuel mixture into the engine 62. Opening the throttle valve results in an increase in propeller speed to thereby increase the velocity of the watercraft.

As fuel is supplied from the fuel tank 53 to the engine 62, the fuel level meter 51 detects the remaining fuel amount in the fuel tank 53 and outputs a fuel amount signal to the ECU 61. The fuel flow rate meter 52 detects the flow rate of fuel flowing from the fuel tank 53 to the engine 62 by measuring the amount of fuel flowing out of the fuel tank 53 per unit time. The fuel flow rate meter 52 outputs the fuel flow rate (fuel consumption rate) information to the ECU 61.

The steering wheel angle sensor 31 detects a turning angle of the steering wheel 30 and outputs a steering angle control signal to the ECU 61. The ECU 61 controls the steering actuator 83 according to the signal from the steering wheel angle sensor 31. For example, when the steering wheel 30 is turned, the ECU 61 signals the steering actuator 83 to actuate the turning mechanism of the transmission mechanism 63. The turning mechanism changes the direction of the outboard motor 12 with respect to the hull 11 and changes the direction of the watercraft 10.

The steering angle sensor 73 detects the direction (angle) of the outboard motor 12 relative to the hull 11 and outputs the detected steering angle information to the ECU 61.

The trim control device varies the horizontal plane surface of the watercraft 10 with respect to the surface of the water in the direction of travel of the watercraft 10. The trim-tilt switch 23 enables the operator to adjust the trim and tilt of the outboard motor 12 with respect to the stern of the hull 11 to allow the operator to optimize the performance and fuel economy of the watercraft 10. The trim-tilt switch provides the ECU 61 with signals representing an operator request, and the ECU 61 controls the trim controller according to the signals from the trim-tilt switch 23. For example, when the watercraft 10 is moving forward, setting the trim-tilt switch 23 in the upward direction increases the inclination of the outboard motor 12 toward the tilt range, which raises the bow of the watercraft 10. Similarly, setting the trim-tilt switch in the downward direction decreases the inclination of the outboard motor 12 toward the trim range, which lowers the bow of the watercraft 10. The trim/tilt adjustment enables the operator to choose the most efficient (in terms of fuel economy), stabilized, and well-balanced operational state of the watercraft 10.

When the bow rises too high, performance and fuel economy deteriorate due to the increase in the water resistance against the bottom of the hull 11. When the bow lowers too much, although watercraft acceleration from the standing state improves, the watercraft 10 can become unstable or difficult to maneuver at high speeds. Fuel efficiency and stability at a particular velocity improve when the bow is raised by a predetermined angle measured between a keel line and the water surface.

How much the bow is raised or lowered to achieve optimal efficiency depends not only on the trim angle but also on the watercraft speed and load (number of people and amount of equipment in the watercraft). Therefore, an efficient watercraft operating state is realized by choosing a trim angle that correctly corresponds to watercraft speed and load.

As illustrated in FIG. 2, the LAN cable 14 comprises a hull-side LAN cable 141 with a connector 142 and a motor-side LAN cable 144 with a connector 143. The connector 142 and the connector 143 are mechanically engaged to electrically or optically interconnect the hull-side LAN cable 141 and the motor-side LAN cable 144.

The hull-side LAN cable 141 is connected to the start-stop switch 21, the lever angle sensor 22, the trim-tilt switch 23, and the steering wheel angle sensor 31 to receive the control signals responsive to the operator commands. The control signals from each sensor or switch are transmitted from the hull-side LAN cable 141 to the ECU 61 via the connectors 142 and 143 and the motor-side LAN cable 144. The ECU 61 is responsive to the control signals to generate the signals applied to the actuators of the outboard motor 12, as discussed above.

The hull-side LAN cable 141 is also connected to the GPS device 42, to the fuel level meter 51, and to the fuel flow rate meter 52. The feedback signals from the GPS device 42, the fuel level meter 51 and the fuel flow meter 52 are transmitted to the ECU 61 via the hull-side LAN cable 141, the connectors 142, 143, and the motor-side LAN cable 144. Similarly, information to be displayed on the active monitor 41 is transmitted from the ECU 61 to the active display 41 via the motor-side LAN cable 144, the connectors 143, 142 and the hull-side LAN cable 141.

The LAN cable 14 (comprising the LAN cables 141 and 144) serves as a control information transmission path to communicate control signals to the outboard motor 12. The LAN cable 14 also serves as an information transmission path to communicate information to the active display 41 to inform the operator of the operating conditions of the watercraft 10, such as, for example, parameter information from the sensors and navigational information.

Unlike previously known watercraft, the hull 11 and the outboard motor 12 of the watercraft 10 of FIGS. 1 and 2 are interconnected via a single communication cable such as the LAN cable 14. Thus, no moving actuator wires or actuator cables are needed between the hull 11 and the outboard motor 12 to communicate control forces from actuators in the hull 11 to components in the outboard motor 12. Therefore, control signals (e.g., information related to the control of the outboard motor 12) and display information (e.g., signals representing operating conditions that are not related to the control of the outboard motor 12) can be sent through the single cable 14.

Figure 3:
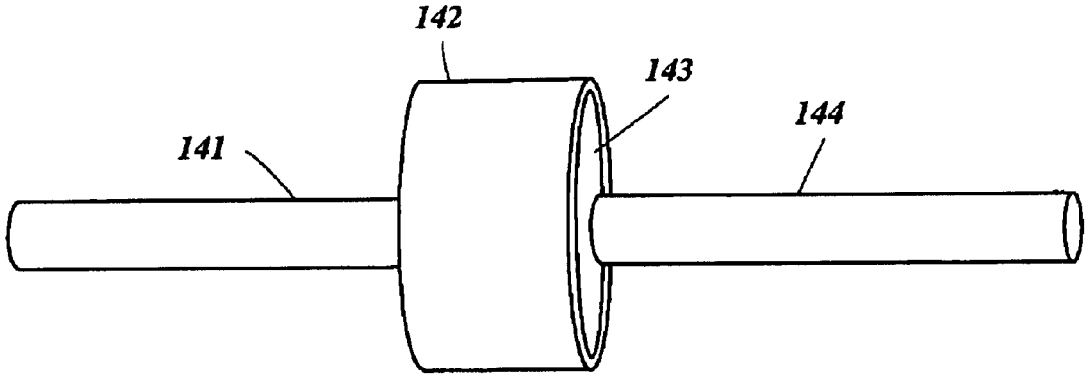
FIG. 3 illustrates a diagram of a local area network connector that advantageously enables communication between various controls on a watercraft and an outboard motor.

FIG. 3 illustrates the connectors 142 and 143 of the LAN cable 14 in more detail. As discussed above in connection with FIG. 2, the hull-side LAN cable 141 originates in the hull 11, and the motor-side LAN cable 144 originates in the outboard motor 12. When the outboard motor 12 is mounted to the hull 11, the connector 142 of the hull-side LAN cable 141 and the connector 143 of the motor-side 143 are mechanically engaged in one simple operation to quickly interconnect the cables 141 and 144 and thereby enable communication of control signals and information between the hull 11 and the outboard motor 12.

In the illustrated embodiment, the connector 142 has a female (recessed) shape, and the connector 143 has a male (projecting) shape. The outside diameter of the male connector 143 has a size and shape corresponding to the inside diameter of the connector 142. In preferred embodiments, the connector 142 is mounted at a fixed location on the side of the hull 11. After the outboard motor 12 is mounted to the stern of the hull 11, the LAN cable 14 is connected by inserting the connector 143 of the motor-side LAN cable 144 from the outboard motor 12 into the connector 142 of the hull-side LAN cable 141. In particularly preferred embodiments, the connectors 142 and 143 are provided with a quick-fit (e.g., a push and turn) type of locking mechanism.

In preferred embodiments, the outside diameter of the hull-mounted connector 142 has a dimensional limit of, for example, 40 millimeters to enable easy installation of the connector 142 into the hull 11. The hull-side LAN cable 141 is usually inserted into a preformed passage in the side of the hull 11. Thus, the outside diameter of the connector 142 should be sufficiently smaller than the inside diameter of the preformed passage. Preferably, the dimensions of the motor-side LAN cable 144 are also selected to be of similar size and shape as the hull-side LAN cable 141.

The active monitor 41 displays many types of useful information to the watercraft operator, including, for example, boat speed S, fuel consumption E, fuel consumption rate F, fuel amount FA, navigation range L, navigation time T, a return-to-port warning, an optimum trim position (angle), and engine conditions.

The ECU 61 performs a plurality of calculations (described below) based on position information from the GPS device 42, the fuel amount from the fuel level meter 51, and the fuel flow rate from the fuel flow rate meter 52. The ECU 61 transmits the calculated results via the LAN cable 14 to the active monitor 41 to show the results to the watercraft operator.

The boat speed S (in km/h or knots (nautical miles/h)) is calculated as the traveled distance of the watercraft 10 divided by the travel time. In the preferred embodiment, the traveled distance is based on the position information from the GPS device 42.

The fuel consumption E (in liters/km or liters/nautical mile, etc.) represents the amount of fuel consumed per unit of distanced traveled. The fuel consumption E is calculated from the watercraft speed S using the following equation:

$$E=F/S, \tag{1}$$

where F represents the amount of fuel consumed per unit time (fuel consumption rate in liters per hour).

The fuel consumption rate F is determined according to the fuel flow rate information from the fuel flow rate meter 52 and the watercraft speed S. The fuel consumption E depends on the speed of the watercraft 10. The fuel consumption E generally decreases as the speed of the watercraft 10 approaches the most efficient speed of the watercraft 10. The most efficient watercraft speed can be defined as a speed where the outboard motor trim angle is set to allow the watercraft to travel in the water with the least possible resistance.

The fuel amount FA is the amount measured as a unit of volume of fuel remaining in the fuel tank 53. The fuel amount FA can be calculated from the fuel amount information from the fuel level meter 51. The fuel amount FA can also be calculated from the following equation:

$$FA=V0-V1=\ddot{A}V, \quad (2)$$

where V0 is the maximum capacity (in liters) of the fuel tank 53, and where V1 is the amount of fuel (in liters) consumed by the engine 62. V1 can be calculated from the fuel flow rate based on the fuel flow rate information from the fuel flow rate meter 52.

The navigation range L is the maximum distance that can be traveled from the current position and can be calculated from the residual fuel amount FA and the fuel consumption E using the following equation:

$$L=FA\times E=\ddot{A}V\times E. \quad (3)$$

Since the fuel consumption E varies with the boat speed S, the navigation range L calculated using the equation L=ÄV×E depends on the watercraft speed S. For example, the navigational range L represents the distance that can be reached when the watercraft 10 is assumed to maintain the current boat speed for a predetermined amount of time.

The navigation time T is the period of time that the watercraft can navigate at a current watercraft speed S. The navigational time T can be calculated from the navigation range L and the watercraft speed S using the equation:

$$T=L/S. \quad (4)$$

The trim angle is closely related to watercraft efficiency. Displaying an optimum trim angle corresponding to a watercraft speed that enables maximum efficiency is convenient for the operator. The operator can operate the trim-tilt switch 23 to set the trim angle of the outboard motor 12 to the displayed optimum trim angle.

A conversion table showing the relationship between the watercraft speed S, watercraft load, and the optimum trim angle can be provided in the auxiliary memory device of the ECU 61. If the conversion table is provided in the auxiliary memory device of the ECU 61, the optimum trim angle can be found by referring to the conversion table and to a parameter such as the watercraft speed S.

When parameters cannot be measured automatically within the watercraft 10, the parameters can be entered manually by the operator while referring to the optimum trim angle displayed. Finding an optimal operating setting for various possible watercraft parameters can also be accomplished, for example, by using tables or graphs showing the relation between the watercraft load and the optimum trim angle corresponding to watercraft designs.

Optimum trim angles corresponding to watercraft speeds can be obtained by a boat builder or by the operator through watercraft testing. These tests can involve operating the watercraft 10 to measure fuel consumption and stability compared to other watercraft with different trim angles, operational speeds, and loads.

Engine parameters can also be displayed on the active monitor 41 to inform the operator of engine condition. For example, the displayed parameters advantageously include engine speed from the engine speed sensor 74, fuel flow rate information from the fuel flow rate meter 52, and cooling water temperature from an engine coolant temperature sensor (not shown).

If the engine 62 experiences a malfunction, the specific malfunction along with a repair suggestion can be displayed on the active monitor 41. A malfunction of the engine 62 can be detected when the engine parameters representing the state of the engine 62 are outside the boundaries of respective normal ranges.

Parameters requiring maintenance and attention can be displayed by referring to a corresponding table showing an engine maintenance schedule. The engine maintenance schedule can include specific service areas of the engine 62 along with repair suggestions to possible engine problems stored in the auxiliary memory device of the ECU 61. For example, if the cooling water temperature rises due to a cooling water suction port being blocked, a high cooling temperature can be sensed by a engine coolant temperature sensor (not shown) and displayed on the active display 41 to assist the operator in diagnosis and prevent watercraft damage.

When plural outboard motors are provided, the individual operating states of each engine 62 may collectively be displayed on the screen of the single active monitor 41.

The above-described information may be displayed not only with characters but also with graphics of the engine 62 to provide easier understanding by the operator. The operator can also be informed of the state of the watercraft by audible aids in addition to the visual information.

In accordance with the embodiments described above, a plurality of actuators such as, for example, the throttle actuator 81, the shift actuator 82, and the steering actuator 83, are disposed in the cowling of the outboard motor 12. The operation system and sensors in the hull 11 along with the engine sensors are connected through the LAN cable 14 to the ECU 61 in the outboard motor 12. As a result, the conventional wires and cables for the throttle device, shifting device, and steering device interconnecting the hull and the outboard motor in previously known watercraft configurations can may be eliminated so that the work of attaching the outboard motor can be accomplished easily and quickly using the embodiments described herein.

According to the present invention as described above, actuators for driving various mechanisms that function in response operator requests such as throttling, shifting, and steering are disposed in the outboard motor. The operation system and sensors in the watercraft are connected through a communication cable to the ECU 61 controlling the actuators of the outboard motor 12. The configuration of the LAN connection between the watercraft 10 and the outboard motor 12 provides a significant reduction in the number of wires and cables between the hull 11 and the outboard motor 12 in comparison to a conventional watercraft and outboard motor. Therefore, mounting of the outboard motor 12 to the hull 11 is simplified and improved.

Although the present invention has been described in terms of a certain preferred embodiments; other embodiments apparent to those of ordinary skill in the art also are within the scope of this invention. Thus, various changes and modifications may be made without departing from the spirit and scope of the invention. Moreover, not all of the features, aspects and advantages are necessarily required to practice the present invention. Accordingly, the scope of the present invention is intended to be defined only by the claims that follow.

What is claimed is:

1. A watercraft that includes an outboard motor mounted on a hull, the watercraft comprising:

an operator-controlled navigational unit positioned in the hull, the navigational unit comprising at least one engine operation control unit that receives throttle and shift commands and that generates throttle and shift command signals, a control unit that receives steering commands and that generates steering command signals, and a trim selection control unit that receives trim selection commands and that generates trim selection command signals;

actuators in the outboard motor, the actuators responsive to control signals to operate a throttle body, a transmission, a steering system, and a trim system; and a control system in the outboard motor and connected via a communication system to the navigational unit, the control system receiving the command signals from the control units in the navigational unit via the communication system and generating the control signals to the actuators in the outboard motor.

2. A watercraft having an outboard motor that includes an engine that produces a propulsion force through a transmission mechanism, the watercraft comprising:

an operator-controlled navigational system comprising at least one engine operation control unit that receives throttle and shift command inputs, a steering control unit that receives steering command inputs, and a trim control unit that receives trim selection command inputs, the control units generating respective control signals responsive to operator inputs applied to the control units;

a display system proximate to the navigational system;

actuators in the outboard motor that operate a throttle body, a transmission, a steering system, and a trim system in response to respective actuator signals;

sensors that detect operating conditions of the watercraft; and a control system in the outboard motor that communicates with the sensors and with the actuators, the control system connected via a communication system to the navigational system to receive the control signals from the control units, the control system responsive to the control signals to generate the actuator signals to the actuators, the control system further generating signals to the display system to cause the display system to display information responsive to the detected operating conditions of the watercraft.

3. An outboard motor mounted on a watercraft, the watercraft including a navigation system that receives control inputs from an operator, the outboard motor including an engine that produces a propulsion force through a transmission mechanism, the outboard motor comprising:

actuators in the outboard motor that operate a throttle body, a transmission, a steering system, and a trim system;

a control system in communication with the navigation system of the watercraft via a communication system, the control system controlling the actuators in response to commands received from the navigation system.

4. An outboard motor mounted on a watercraft, the outboard motor including an engine that produces a propulsion force through a transmission mechanism, the outboard motor comprising:

actuators in the outboard motor that operate a throttle body, a transmission, a steering system, and a trim system; and a control system in communication with a navigation system located in the watercraft, the control system operating actuators in the outboard motor in response to commands received via a communication system from the navigation system, the control system further generating information signals responsive to operating conditions of the outboard motor and the watercraft and communicating the information signals to a display associated with the navigation system.

5. The watercraft of claim 1, wherein the communication system comprises a LAN cable having a first portion and a second portion and a connector assembly coupling said first and second portions.

6. The watercraft of claim 5, wherein said connector assembly comprises a male connector and a female connector and one of said male and female connectors has a dimensional limit of 40 millimeters.

7. The watercraft of claim 1, wherein the communication system comprises a single communication cable that connects said control system in the outboard motor and the navigational unit, said single communication cable having a first portion and a second portion that are connected by a connector assembly.

8. The watercraft of claim 7, wherein said connector assembly is disposed on a side surface of said hull proximate said outboard motor.

9. The watercraft of claim 2, wherein the communication system comprises a LAN cable having a first portion and a second portion and a connector assembly coupling said first and second portions.

10. The watercraft of claim 9, wherein said connector assembly comprises a male connector and a female connector and one of said male and female connectors has a dimensional limit of 40 millimeters.

11. The watercraft of claim 2, wherein the communication system comprises a single communication cable that connects said control system in the outboard motor and the navigational unit, said single communication cable having a first portion and a second portion that are connected by a connector assembly.

12. The watercraft of claim 11, wherein said connector assembly is disposed on a side surface of said hull proximate said outboard motor.

13. The outboard motor of claim 3, wherein the communication system comprises a LAN cable having a first portion and a second portion and a connector assembly coupling said first and second portions.

14. The outboard motor of claim 13, wherein said connector assembly comprises a male connector and a female connector and one of said male and female connectors has a dimensional limit of 40 millimeters.

15. The outboard motor of claim 3, wherein the communication system comprises a single communication cable that connects said control system in the outboard motor and the navigational unit, said single communication cable having a first portion and a second portion that are connected by a connector assembly.

16. The outboard motor of claim 15, wherein said connector assembly is adapted to be disposed on a side surface of a hull of the watercraft proximate said outboard motor.

17. The outboard motor of claim 4, wherein the communication system comprises a LAN cable having a first portion and a second portion and a connector assembly coupling said first and second portions.

18. The outboard motor of claim 17, wherein said connector assembly comprises a male connector and a female connector and one of said male and female connectors has a dimensional limit of 40 millimeters.

19. The outboard motor of claim 4, wherein the communication system comprises a single communication cable that connects said control system in the outboard motor and the navigational unit, said single communication cable having a first portion and a second portion that are connected by a connector assembly.

20. The outboard motor of claim 19, wherein said connector assembly is adapted to be disposed on a side surface of a hull of the watercraft proximate said outboard motor.

* * * * *

UNITED STATES PATENT AND TRADEMARK OFFICE

CERTIFICATE OF CORRECTION

PATENT NO. : 6,910,927 B2
APPLICATION NO. : 10/281390
DATED : June 28, 2005
INVENTOR(S) : Isao Kanno It is certified that error appears in the above-identified patent and that said Letters Patent is hereby corrected as shown below:

Column 1, Line 5, please delete "@NMEA" and insert -- @NMEWA --, therefore.

Column 2, Line 10, please delete "IS)" and insert -- (IS) --, therefore.

Column 4, Line 16, please delete "work" and insert -- other network --, therefore.

Column 9, Line 7, please delete "=ÄV," and insert -- =ΔV, --, therefore.

Column 9, Line 18, please delete "=ÄVxE." and insert -- =ΔVxE. --, therefore.

Column 9, Line 22, please delete "ÄVxE" and insert -- ΔVxE --, therefore.

Column 10, Line 11, please delete "a engine" and insert -- an engine --, therefore.

Signed and Sealed this

Twenty-fourth Day of July, 2007

JON W. DUDAS
*Director of the United States Patent and Trademark Office*